US012781151B2

(12) United States Patent
Osawa

(10) Patent No.: US 12,781,151 B2
(45) Date of Patent: Nov. 3, 2026

(54) GREASE COMPOSITION FOR OUTBOARD CONSTANT VELOCITY JOINTS

(71) Applicant: KYODO YUSHI CO., LTD., Fujisawa (JP)

(72) Inventor: Hisayuki Osawa, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 18/863,555

(22) PCT Filed: May 12, 2023

(86) PCT No.: PCT/JP2023/017889
§ 371 (c)(1),
(2) Date: Nov. 6, 2024

(87) PCT Pub. No.: WO2023/219161
PCT Pub. Date: Nov. 16, 2023

(65) Prior Publication Data

US 2025/0263622 A1 Aug. 21, 2025

(30) Foreign Application Priority Data

May 12, 2022 (JP) ..... 2022-078604

(51) Int. Cl.

| | |
|---|---|
| ***C10M 169/02*** | (2006.01) |
| *C10N 20/02* | (2006.01) |
| *C10N 40/04* | (2006.01) |
| *C10N 50/10* | (2006.01) |

(52) U.S. Cl.
CPC .. *C10M 169/02* (2013.01); *C10M 2215/1026* (2013.01); *C10N 2020/02* (2013.01); *C10N 2040/046* (2020.05); *C10N 2050/10* (2013.01)

(58) Field of Classification Search
CPC ..... C10M 169/02; C10M 2215/1026; C10N 2020/02; C10N 2040/046; C10N 2050/10
See application file for complete search history.

(56) References Cited

U.S. PATENT DOCUMENTS

| | | | | |
|---|---|---|---|---|
| 4,915,860 | A * | 4/1990 | Kinoshita | C10M 115/08 508/552 |
| 5,607,906 | A * | 3/1997 | Okaniwa | C10M 159/20 508/552 |
| 2006/0154831 | A1* | 7/2006 | Iwano | C10M 159/24 508/552 |
| 2008/0132341 | A1* | 6/2008 | Momiyama | F16D 3/2055 508/158 |
| 2008/0161214 | A1* | 7/2008 | Asakura | C10M 169/06 508/179 |
| 2008/0234150 | A1 | 9/2008 | Kakizaki et al. | |
| 2009/0291866 | A1 | 11/2009 | Kakizaki et al. | |
| 2010/0323934 | A1 | 12/2010 | Kondo et al. | |
| 2011/0059875 | A1 | 3/2011 | Tanimura et al. | |
| 2011/0168479 | A1* | 7/2011 | Nakata | C10M 161/00 508/276 |
| 2011/0306429 | A1 | 12/2011 | Mikami et al. | |
| 2013/0079158 | A1 | 3/2013 | Kakizaki et al. | |
| 2013/0276563 | A1 | 10/2013 | Kawamura et al. | |
| 2014/0193110 | A1* | 7/2014 | Soga | F16C 33/6633 508/439 |
| 2014/0228135 | A1 | 8/2014 | Kondo et al. | |
| 2015/0105304 | A1 | 4/2015 | Mikami et al. | |
| 2021/0171858 | A1* | 6/2021 | Tanaka | C10M 169/06 |

FOREIGN PATENT DOCUMENTS

| | | | | |
|---|---|---|---|---|
| EP | 2492531 | A1 | 8/2012 | |
| JP | 2008069282 | A | 3/2008 | |
| JP | 2008163201 | A | 7/2008 | |
| JP | 2009270058 | A | 11/2009 | |
| JP | 2010070592 | A | 4/2010 | |
| JP | 2010222560 | A | 10/2010 | |
| JP | 2011063659 | A | 3/2011 | |
| JP | 2012077283 | A | 4/2012 | |
| JP | 2014114918 | A | 6/2014 | |
| WO | 2007060978 | A1 | 5/2007 | |
| WO | 2008007671 | A1 | 1/2008 | |
| WO | 2009136649 | A1 | 11/2009 | |
| WO | 2012090722 | A1 | 7/2012 | |
| WO | WO-2017125581 | A1 * | 7/2017 | C10M 169/06 |

OTHER PUBLICATIONS

Chevron Phillips Chemicals—Synfluid PAO 8 cSt, revision date Jul. 2022 (Year: 2022).*

Extended European Search Report issued on Feb. 17, 2025, by the European Patent Office in corresponding EP Application No. 23803635.4 (6 pages).

International Search Report (PCT/ISA/210) and Written Opinion (PCT/ISA/237) issued on Jul. 18, 2023, by the Japan Patent Office in corresponding International Application No. PCT/JP2023/017889, with English translation of the Search Report (10 pages).

* cited by examiner

*Primary Examiner* — Cephia D Toomer
(74) *Attorney, Agent, or Firm* — Panitch Schwarze Belisario & Nadel LLP

(57) ABSTRACT

A grease composition for outboard constant velocity joints includes (a) a diurea-based thickener and (b) a base oil containing a synthetic oil and having a kinematic viscosity at a temperature of −20° C. measured according to JIS K 2283 of 3.000 to 20.000 $mm^2/s$.

5 Claims, No Drawings

GREASE COMPOSITION FOR OUTBOARD CONSTANT VELOCITY JOINTS

CROSS-REFERENCE TO RELATED APPLICATIONS

This application is a Section 371 of International Application No. PCT/JP2023/017889, filed May 12, 2023, which was published in the Japanese language on Nov. 16, 2023, under International Publication No. WO 2023/219161 A1, which claims priority under 35 U.S.C. § 119(b) to Japanese Application No. 2022-078604, filed May 12, 2022, the disclosures of which are incorporated herein by reference in their entirety.

TECHNICAL FIELD

The present invention relates to a grease composition for outboard constant velocity joints.

BACKGROUND ART

In automobiles, front-engine, front-wheel (FF) drive vehicles have become widespread due to lightweight construction aimed at environmental measures for vehicles (CO2 reduction) and securing passenger space, and constant velocity joints (CVJs), which are indispensable for power transmission in FF vehicles, are used.

Since CVJs rotate at an angle, the joint internal parts perform complex rolling and sliding motion. Among CVJs, the outboard side moves the wheels and steers, so that the operating angle may become large. At high operating angles, the rolling and sliding speed and the load between the balls and the transfer surfaces of the inner and outer rings become significantly large, making it difficult to form a lubricating film, and noise may be generated due to stick-slip.

In particular, when a car is left outdoors for a long time during periods of severe cold, the fluidity of the grease in the CVJs deteriorates further when it is completely cooled; when the car is started with a large operating angle, the sound pressure of the generated noise becomes high and the duration becomes long, which is problematic because quietness is impaired.

As CVJ greases aimed at reducing low-temperature starting rotational torque at low temperatures, grease containing a base oil including synthetic oil, a thickener, zinc dithiophosphate, molybdenum dialkyldithiocarbamate sulfide, and zinc dialkyldithiocarbamate (see Patent Literature 1), and grease containing a base oil including 10 to 95% of an ester-based synthetic oil produced from an aliphatic alcohol and an aromatic carboxylic acid and 90 to 5% of a synthetic hydrocarbon oil, a thickener, molybdenum disulfide, molybdenum dialkyldithiocarbamate sulfide, and zinc dithiophosphate (see Patent Literature 2) have been proposed; however, it cannot be said that sufficient studies have been conducted on the effect of suppressing noise due to grease fluidity at low temperatures.

CITATION LIST

Patent Literatures

Patent Literature 1: Japanese Patent Application Publication No. 2009-270058

Patent Literature 2: Japanese Patent Application Publication No. 2008-163201

SUMMARY OF INVENTION

Problems to Be Solved by the Invention

An object of the present invention is to provide a grease composition for outboard constant velocity joints that is excellent in noise suppression effect at low temperatures.

Means for Solution of the Problems

The present inventors have found that a grease composition containing a base oil having a specific kinematic viscosity and a urea thickener is excellent in noise suppression performance at low temperatures.

That is, the present invention provides the following grease composition for outboard constant velocity joints and a constant velocity joint filled with the same.

1. A grease composition for outboard constant velocity joints, comprising the following components:
   (a) a diurea-based thickener; and
   (b) a base oil containing a synthetic oil and having a kinematic viscosity at a temperature of −20° C. measured according to JIS K 2283 of 3,000 to 20,000 $mm^2/s$.
2. The grease composition according to the above 1, wherein the kinematic viscosity of the base oil (b) at 100° C. is 8 to 20 $mm^2/s$.
3. An outboard constant velocity joint filled with the grease composition according to the above 1 or 2.

Advantageous Effects of Invention

The grease composition of the present invention is excellent in noise suppression performance in a low-temperature environment.

DESCRIPTION OF EMBODIMENTS (a) Diurea-Based Thickener

The thickener of the present invention is a diurea-based thickener. As the diurea-based thickener, a diurea compound selected from the group consisting of aliphatic diurea compounds, aromatic diurea compounds, and alicyclic diurea compounds is used. The diurea compound is obtained by reacting a diisocyanate component and a monoamine component. Examples of the diisocyanate include phenylene diisocyanate, diphenylmethane diisocyanate, octadecane diisocyanate, decane diisocyanate, and hexane diisocyanate; examples of the monoamine include octylamine, dodecylamine, hexadecylamine, stearylamine, oleylamine, aniline, p-toluidine, and cyclohexylamine.

A preferred diurea compound for use in the present application is a diurea-based thickener represented by the following formula (1):

$$R1NH—CO—NH—C6H4\text{-}p\text{-}CH2\text{-}C6H4\text{-}p\text{-}NH—CO—NHR1' \quad (1)$$

(wherein R1 and R1' are each independently an octyl group, a dodecyl group, a hexadecyl group, an octadecyl group, a cyclohexyl group, or a phenyl group).

Examples of the diurea-based thickener of formula (1) include aliphatic diurea in which both R1 and R1' are an octyl group, a dodecyl group, a hexadecyl group, or an octadecyl group, alicyclic aliphatic diurea including a diurea compound in which one of R1 and R1' is an octyl group, a dodecyl group, a hexadecyl group, or an octadecyl group and the other is a cyclohexyl group, alicyclic diurea in which both R1 and R1' are a cyclohexyl group, aliphatic aromatic diurea including a diurea compound in which one of R1 and R1' is an octyl group, a dodecyl group, a hexadecyl group, or an octadecyl group and the other is a phenyl group, aromatic diurea in which both R1 and R1' are a phenyl group, and alicyclic aromatic diurea including a diurea compound in which one of R1 and R1' is a cyclohexyl group and the other is a phenyl group.

The thickener is more preferably an alicyclic aromatic diurea thickener because it tends to thicken the grease at the lubricated part, which leads to improved durability. As the alicyclic aromatic diurea thickener, a diurea compound in which one of R1 and R1' in formula (1) is a phenyl group and the other is a cyclohexyl group is preferable. The alicyclic aromatic diurea thickener is a reaction mixture of a diisocyanate and an alicyclic amine and an aromatic amine, so that it also includes a reaction product of a diisocyanate and an alicyclic amine (i.e., a diurea compound in which both R1 and R1' in formula (1) are a cyclohexyl group) and a reaction product of a diisocyanate and an aromatic amine (i.e., a diurea compound in which both R1 and R1' in formula (1) are a phenyl group). From the viewpoint of ensuring the film thickness of the grease composed of the thickener and the base oil, the molar ratio of the cyclohexyl group to the phenyl group in the alicyclic aromatic diurea thickener is preferably 2:8 to 4:6, and more preferably 7:3.

The content of the thickener may be any amount that can adjust the consistency of the grease to 310 to 375, and is specifically preferably 8 to 18% by mass, more preferably 10 to 16% by mass, and even more preferably 11 to 15% by mass, based on the total mass of the composition. In this specification, "consistency" means the 60-stroke worked consistency measured according to JIS K 2220.7.

(b) Base Oil

The base oil of the present invention has a kinematic viscosity at −20° C. of 3,000 to 20,000 $mm^2/s$. When the kinematic viscosity at −20° C. is 3,000 to 20,000 $mm^2/s$, the fluidity of the grease in the CVJ at low temperatures can be ensured, and noise generated by stick-slip of the lubricated part can be suppressed. The kinematic viscosity at −20° C. is preferably 3300 to 17000 $mm^2/s$, and more preferably 3500 to 15000 $mm^2/s$.

As long as the kinematic viscosity at −20° C. is in such a range, the type of base oil used in the present invention is not particularly limited. Examples thereof include mineral oils represented by naphthenic and paraffinic oils, synthetic hydrocarbon oils represented by polyalphaolefins and polybutenes, ether-based synthetic oils represented by alkyl diphenyl ethers, silicone oils, fluorinated oils, and other various synthetic oils. The synthetic oil may be a so-called biomass oil produced from biological resources derived from animals and plants. For example, biomass ester oils synthesized from various fatty acids and alcohols derived from vegetable oils, and biomass hydrocarbon oils using vegetable oils such as palm oil, corn oil, and soybean oil can also be used. Among these, synthetic hydrocarbon oils are preferred, and polyalphaolefins are more preferred. The base oil may be used alone or in combination of two or more. From the viewpoint of ensuring low-temperature properties, it is preferable to include a synthetic hydrocarbon oil. From the viewpoint of the balance between ensuring low-temperature properties and cost, a mixture of a synthetic hydrocarbon oil and a mineral oil is particularly preferred. A mixture of a polyalphaolefin and a mineral oil is even more particularly preferred. When the base oil is a mixture of a synthetic oil (e.g., polyalphaolefin) and a mineral oil, the kinematic viscosity of the base oil at −20° C. may be within the above range; specifically, the proportion of the synthetic oil in the entire base oil is up to about 30% by mass.

The kinematic viscosity of the base oil of the present invention at 100° C. is preferably 8 $mm^2/s$ or more, and more preferably 10 $mm^2/s$ or more, from the viewpoint of ensuring the oil film thickness of the base oil and preventing metal contact at the lubricated part in the CVJ at high temperatures, thereby improving durability. Since the oil film thickness of the base oil can be ensured at the lubricated part in the CVJ and metal contact can be prevented, thereby improving durability, the higher the kinematic viscosity at 100° C. is, the better; however, the viscosity on the low-temperature side increases, so that the kinematic viscosity at 100° C. is preferably 20 $mm^2/s$ or less, and more preferably 17 $mm^2/s$ or less.

The kinematic viscosity of the base oil can be measured according to JIS K 2283.

The viscosity index of the base oil is preferably 120 to 150, and more preferably 130 to 140. Within this range, the change in the kinematic viscosity of the base oil with temperature change is small, so that an increase in the kinematic viscosity at low temperatures due to an increase in the kinematic viscosity at high temperatures can be suppressed. In addition, the viscosity does not become too high at low temperatures. In addition, the base oil having a kinematic viscosity within the above range contains little or no aroma or naphthene components that adsorb to the metal surface in the joint and hinder the operation of each component at low temperatures, which can contribute to suppressing noise generation at low temperatures. The viscosity index of the base oil can be calculated according to JIS K 2283.

The content of the base oil is preferably 70 to 90% by mass, more preferably 73 to 88% by mass, and even more preferably 75 to 85% by mass, based on the total mass of the composition, from the viewpoint of grease fluidity.

The grease composition of the present invention may contain, in addition to the above components, additives usually used in grease compositions, such as extreme pressure additives, antioxidants, and rust inhibitors.

Examples of the additive used in the present invention include molybdenum dialkyldithiocarbamate (MoDTC), molybdenum disulfide, overbased Ca sulfonate, and sulfur-based extreme pressure agents.

The molybdenum dialkyldithiocarbamate is particularly preferably represented by the following formula. MoDTC is preferably represented by the following formula (2):

$$[R^{30}{}_2N—CS—S]_2—Mo_2OmSn \quad (2)$$

(wherein $R^{30}$ is a primary or secondary alkyl group having 1 to 4 carbon atoms, preferably a primary or secondary alkyl group having 2 to 4 carbon atoms, m is 0 to 3, n is 1 to 4, and m+n=4).

The content of molybdenum dialkyldithiocarbamate is preferably 1.0 to 4.0% by mass, more preferably 1.5 to 3.5% by mass, and even more preferably 2.0 to 3.0% by mass, based on the total mass of the composition, from the viewpoint of low friction. By including molybdenum dialkyldithiocarbamate in such a range, sufficient low friction can be obtained.

The molybdenum disulfide is generally widely used as a solid lubricant. This compound has a layered lattice structure, is easily sheared into thin layers by sliding motion, prevents metal contact, and has a seizure prevention effect.

The content of molybdenum disulfide is preferably 0.3 to 2.5% by mass, more preferably 0.5 to 2.0% by mass, and even more preferably 0.7 to 1.5% by mass, based on the total mass of the composition, from the viewpoint of seizure resistance. By including molybdenum disulfide in such a range, sufficient low friction can be obtained.

Examples of the overbased Ca sulfonate include overbased calcium salts of alkyl aromatic sulfonic acids, overbased calcium salts of petroleum sulfonic acids, overbased calcium salts of oxidized waxes, and combinations thereof. Among these, overbased calcium salts of alkyl aromatic sulfonic acids are preferred.

The overbased Ca sulfonate is not particularly limited in base number as long as it is overbased, and the base number measured according to JIS K 2501 is, for example, 200 to 500 mg KOH/g, preferably 250 to 450 mg KOH/g, and more preferably 300 to 400 mg KOH/g. If the base number is within the above range, it may be used in combination with a Ca sulfonate other than the overbased Ca sulfonate (e.g., neutral Ca sulfonate).

The content of the overbased Ca sulfonate is preferably 0.3 to 2.5% by mass, more preferably 0.5 to 2.0% by mass, and even more preferably 0.7 to 1.5% by mass, based on the total mass of the composition. By including the overbased Ca sulfonate in such a range, sufficient low friction can be obtained.

Examples of the sulfur-based extreme pressure additive include sulfurized olefins, polysulfides, and sulfurized oils and/or fats. These may be used alone or in combination of two or more.

The sulfurized olefin that can be used in the present invention can be represented by the following general formula (3):

$$R^{10}S(Sx\text{-}R^{20}Sy)z\text{-}R^{10} \quad (3)$$

(wherein x is an integer of 0, 1, or 2, y is an integer of 1 to 3, z is an integer of 1 to 10, and $R^{10}$ and $R^{20}$ each independently represent a saturated or unsaturated hydrocarbon group having 4 to 10 carbon atoms).

The sulfurized olefin may be synthesized by a known method or a commercially available product may be used.

The content of the sulfur-based extreme pressure agent is preferably 0.3 to 2.5% by mass, more preferably 0.5 to 2.0% by mass, and even more preferably 0.7 to 1.5% by mass, based on the total mass of the composition. By including the sulfur-based extreme pressure agent in such a range, sufficient low friction can be obtained.

The grease composition of the present invention preferably contains MoDTC, molybdenum disulfide, overbased Ca sulfonate, and a sulfur-based extreme pressure agent. The grease composition of the present invention may further contain, in addition to the above components, other additives usually used in grease compositions, such as other extreme pressure additives, antioxidants, and rust inhibitors. Examples of other extreme pressure additives include phosphate esters. Examples of antioxidants include amine-based and phenol-based antioxidants. Examples of rust inhibitors include sulfonate-based, carboxylic acid-based, and amine-based rust inhibitors. The content of such an optional additive is, for example, 0.1 to 3.0% by mass, preferably 0.3 to 2.0% by mass, based on the total mass of the composition.

EXAMPLES

Grease compositions of Examples and Comparative Examples were prepared using the following components. Specifically, 1 mol of 4',4-diphenylmethane diisocyanate and 2 mol of amine (cyclohexylamine:aniline=7:3, molar ratio) were reacted in a base oil, the temperature was raised and then lowered, and the mixture was kneaded with a three-roll mill to obtain a base grease. Additives shown in Table 1 were blended therein, a base oil was further added so that the amount of the thickener became the ratio shown in Table 1, the mixture was dispersed with a three-roll mill, and the worked consistency was adjusted to the value shown in Table 1 to obtain grease compositions of Examples and Comparative Examples. In Table 1, "Ratio %" of mineral oil and synthetic hydrocarbon oil indicates % by mass based on the total amount of the base oil. The numerical values for other component (a), components (b), and additives indicate % by mass of each component based on the total amount of the composition.

<Thickener>

Alicyclic aromatic diurea: a reaction product of 1 mol of 4',4-diphenylmethane diisocyanate and 2 mol of amine (cyclohexylamine:aniline=7:3, molar ratio)

<Base Oil>

Mineral oil (kinematic viscosity: 188.4 $mm^2/s$ @ 40° C., 17.41 $mm^2/s$ @ 100° C.)

Synthetic hydrocarbon oil: polyalphaolefin (kinematic viscosity: 14.21 $mm^2/s$ @ 40° C., 99.56 $mm^2/s$ @ 100° C.) or polybutene (kinematic viscosity: 160000 $mm^2/s$ @ 40° C., 3700 $mm^2/s$ @ 100° C.)

In Table 1, the base oil "solidified" at −20° C. means that the kinematic viscosity at −20° C. cannot be measured.

<Additive>

MoDTC: molybdenum dialkyldithiocarbamate

Molybdenum disulfide

Overbased Ca sulfonate: calcium salt of alkyl aromatic sulfonic acid (base number 300 to 400 mg KOH/g)

Sulfur-based additive: sulfurized olefin

<Test Method>

Worked consistency of grease: measured according to JIS K2220.

Kinematic viscosity of base oil: measured at 100° C., 40° C., and −20° C. according to JIS K 2283.

Actual machine low-temperature noise measurement: a commercially available outboard constant velocity joint was attached to a rotation tester and cooled to −40° C., the joint was operated under the following conditions, and sound collection was started when a predetermined temperature was reached. The test conditions are as follows:

Joint operating angle: 35°

Rotation speed: 200 rpm

Load torque: 600 Nm

Temperature: −35° C. to −33° C.

The actual machine low-temperature noise sound pressure was evaluated by measuring the noise level including the background noise of the rotation tester using a digital sound level meter with a built-in sound collection microphone. The results are expressed as a percentage of the difference between the noise level including the noise and the background noise measured in advance before the test.

In addition, the results of listening directly with the ear during the actual machine low-temperature noise measurement are shown according to the following evaluation criteria:

○: No noise was heard.

x: Noise was heard.

TABLE 1

| | | | Example 1 | Example 2 | Example 3 | Example 4 | Example 5 | Comparative Example 1 |
|---|---|---|---|---|---|---|---|---|
| (a) | Alicyclic Aromatic Diurea | | 14.0 | 14.0 | 14.0 | 14.0 | 14.0 | 13.6 |
| (b) | Base Oil | Total Base Oil Amount | Balance | Balance | Balance | Balance | Balance | Balance |
| | | Mineral Oil Ratio % | 30 | 20 | 10 | 0 | 0 | 40 |
| | | Synthetic Hydrocarbon Oil Ratio % | 70 | 80 | 90 | 100 | 100 | 60 |
| Additive | MoDTC | | 2.5 | 2.5 | 2.5 | 2.5 | 2.5 | 2.5 |
| | Molybdenum Disulfide | | 1.0 | 1.0 | 1.0 | 1.0 | 1.0 | 1.0 |
| | Overbased Ca Sulfonate | | 1.0 | 1.0 | 1.0 | 1.0 | 1.0 | 1.0 |
| | Sulfur-Based Extreme Pressure Agent | | 1.0 | 1.0 | 1.0 | 1.0 | 1.0 | 1.0 |
| Worked Consistency | | | 354 | 353 | 348 | 344 | 358 | 351 |
| Kinematic Viscosity of Base Oil | | 100° C. [$mm^2/s$] | 14.8 | 14.6 | 14.4 | 14.1 | 10.2 | 15.0 |
| | | 40° C. [$mm^2/s$] | 114 | 110 | 105 | 101 | 65.2 | 121 |
| | | −20° C. [$mm^2/s$] | 12000 | 7420 | 5810 | 5100 | 3720 | Solidified |
| Viscosity Index of Base Oil | | | 136 | 136 | 141 | 142 | 143 | 128 |
| Sound Pressure Measurement of Actual Machine Low-Temperature Noise | | Difference from Background Noise [%] | −2 | +1 | −1 | −1 | +0 | +6 |
| | | Whether or Not Noise Was Heard | ○ | ○ | ○ | ○ | ○ | X |

| | | | Comparative Example 2 | Comparative Example 3 |
|---|---|---|---|---|
| (a) | Alicyclic Aromatic Diurea | | 13.6 | 13.0 |
| (b) | Base Oil | Total Base Oil Amount | Balance | Balance |
| | | Mineral Oil Ratio % | 50 | 0 |
| | | Synthetic Hydrocarbon Oil Ratio % | 50 | 100 |
| Additive | MoDTC | | 2.5 | 2.5 |
| | Molybdenum Disulfide | | 1.0 | 1.0 |
| | Overbased Ca Sulfonate | | 1.0 | 1.0 |
| | Sulfur-Based Extreme Pressure Agent | | 1.0 | 1.0 |
| Worked Consistency | | | 345 | 341 |
| Kinematic Viscosity of Base Oil | | 100° C. [$mm^2/s$] | 15.3 | 22.0 |
| | | 40° C. [$mm^2/s$] | 129 | 188 |
| | | −20° C. [$mm^2/s$] | Solidified | 22000 |
| Viscosity Index of Base Oil | | | 123 | 141 |
| Sound Pressure Measurement of Actual Machine Low-Temperature Noise | | Difference from Background Noise [%] | +10 | +5 |
| | | Whether or Not Noise Was Heard | X | X |

What is claimed is:

1. A grease composition for outboard constant velocity joints, comprising the following components:

(a) a diurea-based thickener;

(b) a base oil containing as a synthetic oil poly-alpha-olefin and a mineral oil, having a kinematic viscosity at a temperature of −20° C. measured according to JIS K 2283 of 3,000 to 20,000 $mm^2/s$; and an overbased Ca sulfonate, wherein the kinematic viscosity of the base oil (b) at 100° C. is 8 to 20 $mm^2/s$, wherein a proportion of the mineral oil in the entire base oil is up to about 30% by mass, wherein the diurea-based thickener comprises an alicyclic aromatic compound by the following formula (1):

$$R1NH—CO—NH—C6H4\text{-}p\text{-}CH2\text{-}C6H4\text{-}p\text{-}NH—CO—NHR1' \quad (1)$$

in which one of R1 and R1' is a phenyl group and the other is a cyclohexyl group, and a molar ratio of the cyclohexyl group to the phenyl group in the alicyclic aromatic compound is 7:3.

2. An outboard constant velocity joint filled with the grease composition according to claim 1.

3. The grease composition according to claim 1, wherein the content of the base oil is 70 to 90% by mass based on a total mass of the composition.

4. The grease composition according to claim 1, wherein a content of the diurea-based thickener is 8 to 18% by mass based on a total mass of the composition.

5. The grease composition according to claim 1, wherein a content of the overbased Ca sulfonate is 0.3 to 2.5% by mass based on a total mass of the composition.

* * * * *